US006438337B1

(12) United States Patent
Abe

(10) Patent No.: US 6,438,337 B1
(45) Date of Patent: Aug. 20, 2002

(54) IMAGE FORMING APPARATUS HAVING MEANS FOR PREVENTING DEVELOPER PASSING THROUGH CLEANING MEMBER

(75) Inventor: Takuma Abe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,452

(22) Filed: Jul. 31, 2000

(30) Foreign Application Priority Data

Aug. 3, 1999 (JP) ..... 11-219474

(51) Int. Cl.[7] ..... G03G 15/00; G03G 21/00

(52) U.S. Cl. ..... 399/71; 399/44; 399/169; 399/296; 399/343

(58) Field of Search ..... 399/343, 349, 399/169, 296, 44, 97, 71; 430/125

(56) References Cited

U.S. PATENT DOCUMENTS 4,502,780 A * 3/1985 Suzuki et al. ..... 399/349
4,739,370 A * 4/1988 Yoshida et al. ..... 399/349 X
4,972,233 A * 11/1990 Yamazaki et al. ..... 399/349 X
5,107,285 A * 4/1992 Hamada et al. ..... 399/169 X
5,249,025 A * 9/1993 Nakazawa et al. ..... 399/349
5,648,842 A * 7/1997 Sekine et al. ..... 430/125 X
6,014,540 A * 1/2000 Sako et al. ..... 399/343

FOREIGN PATENT DOCUMENTS

JP 63-060467 * 3/1988

* cited by examiner

*Primary Examiner*—Sophia S. Chen
(74) *Attorney, Agent, or Firm*—Fitzpatrick, Cella, Harper & Scinto

(57) ABSTRACT

The present invention provides an image forming apparatus which has an image bearing member developing device for developing an electrostatic latent image formed on the image bearing member with developer, cleaning device for removing residual developer on the image bearing member by contacting with the image bearing member at a cleaning position, charging applying device for applying charge of polarity opposite to normal charging polarity of the developer to the developer before the developer applied to the image bearing member is carried to the cleaning position, wherein a developer image formed on the image bearing member by the developing device is transferred onto a transfer material and wherein the developing device applies developer to an area of the image bearing member which is not contacted with the transfer material, and the developer is carried to the cleaning position by the image bearing member.

11 Claims, 4 Drawing Sheets

IMAGE FORMING APPARATUS HAVING MEANS FOR PREVENTING DEVELOPER PASSING THROUGH CLEANING MEMBER

BACKGROUND OF THE INVENTION

1. Field of the Invention

The present invention relates to an image forming apparatus such as an electrostatic copying machine, an electrostatic printer and the like.

2. Related Background Art

In conventional image forming apparatuses in which a toner image is formed by applying developer to an electrostatic latent image formed on a surface of an image bearing member and the toner image is electrostatically transferred onto a transfer sheet and then the transfer sheet is heated and pressurized to fix the toner image to the transfer sheet, since it is difficult to transfer the entire developer on the image bearing member onto the transfer sheet during the transferring operation, small amount of developer always remains on the image bearing member.

Thus, in order to obtain a good quality image, residual toner (developer) remaining on the image bearing member must be removed adequately. Various means for removing the residual toner have been proposed. Among them, since an arrangement in which a sharp edge of a blade made of elastic material such as rubber is urged against the surface of the image bearing member to scrape the residual toner has a simple construction and cheap and has excellent toner removing ability, such an arrangement has widely been used.

FIG. 5 shows a typical example of such a cleaning device for an image forming apparatus. In this example, a cleaning device including a housing 9 having an opening direction toward an image bearing member is disposed in parallel with the image bearing member having an axis perpendicular to the plane of FIG. 5 and rotated in a direction shown by the arrow.

Residual toner not contributing to the transferring and remaining on the image bearing member at a lower side transfer section (not shown) is advanced to a cleaning blade 9B as cleaning means, where the residual toner is scraped by the cleaning blade. The scraped toner is carried to a conveying screw 9D through a magnet roller 9E, a doctor roller 9F and the like and then is discharged and collected. Here, since magnetic toner is used, the toner is magnetically attracted onto the magnet roller 9E.

In such a cleaning device, when the device is used for a long term, the toner particles are gradually accumulated at a contact area between the blade edge and the image bearing member, thereby reducing the cleaning ability.

It is considered that adhesion and aggregation of toner onto the blade edge is caused by lateral shifting of toner, electrostatic coherence of toner to the blade edge and/or combination thereof. Further, products such as fine powder, rosin and talc generated from the transfer sheet comprised of plain paper, and various substances such as nitride and dust caused by the presence of high voltage members such as a corona charger within the apparatus are shifted and aggregated on the blade edge together with the toner.

If such a condition occurs, the aggregated or cohered toner may be passed through the blade edge to push the blade edge upwardly thereby to worsen the cleaning ability, or the surface of the image bearing member may be abraded or the blade edge may be damaged by the foreign matters included in the residual toner.

To avoid this, while various attempts—for example, the blade edge is configured to make accumulation of toner difficult or the cleaning blade is vibrated to drop the accumulated matters—have been made, satisfactory results have not yet been obtained.

Further, due to the presence of additives added to the toner, the developer is partially aggregated electrostatically by to enter between the blade edge and the image bearing member or is totally aggregated electrostatically along the blade edge to push the blade edge upwardly, with the result that developer blank of 10 cm at the maximum such as streaklike blank in the former case or bandlike blank in the latter case may occur.

SUMMARY OF THE INVENTION

An object of the present invention is to provide an image forming apparatus in which developer is prevented from passing through cleaning means.

Another object of the present invention is to provide an image forming apparatus in which image blank such as streaklike blank or bandlike blank is prevented.

A further object of the present invention is to provide an image forming apparatus in which developer accumulated in cleaning means is electrostatically aggregated or cohered.

The other objects and features of the present invention will be apparent from the following detailed explanation of invention referring to the accompanying drawings.

DETAILED DESCRIPTION OF THE PREFERRED EMBODIMENTS

Figure 1:
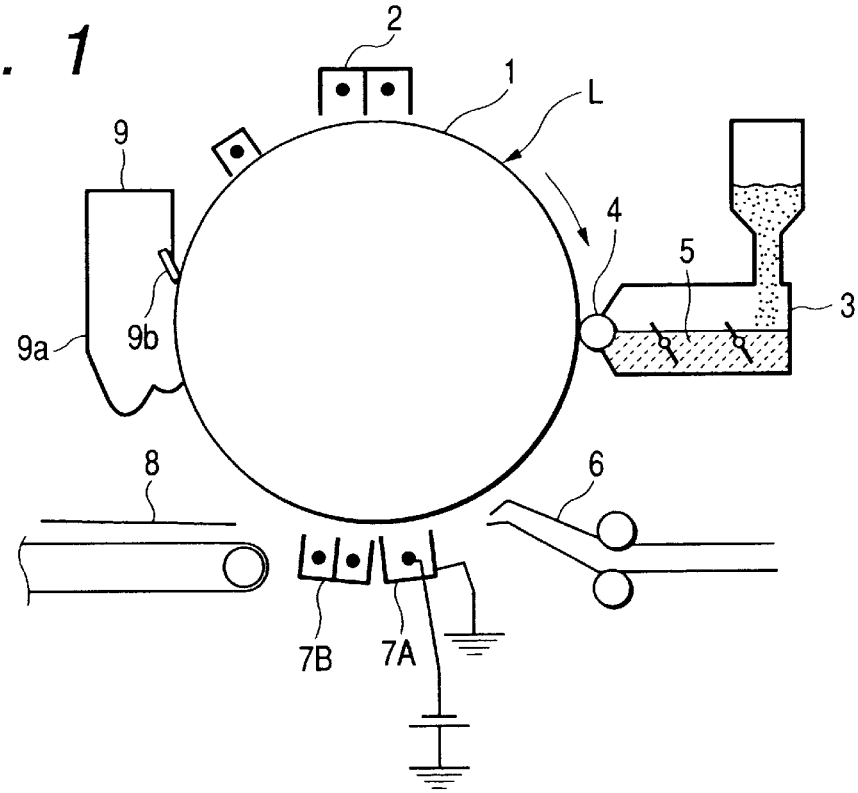
FIG 1 is a schematic side view of an image forming apparatus according to a first embodiment of the present invention.

FIG. 1 is a schematic side view of an image forming apparatus according to a first embodiment of the present invention. In this image forming apparatus, by applying charge bias to a primary charger 2 disposed in the vicinity of an image bearing member 1 having an axis perpendicular to the plane of FIG. 1 and rotated in a direction shown by the arrow, a photosensitive layer on the surface of the image bearing member is uniformly charged.

As the image bearing member 1 is rotated, the charged surface of the image bearing member is subjected to image exposure L corresponding to an image signal by a laser scanner thereby to form an electrostatic latent image. When the electrostatic latent image reaches a developing section where a developing device 3 is located, toner 5 as developer contained in the developing device is frictionally charged with positive polarity (which is normal charging polarity) and is applied to the latent image by a developing roller 4, thereby forming a toner image. The developer includes one-component magnetic toner.

As the image bearing member 1 is rotated, when the toner image reaches a transfer/separation section where a transfer charger 7A and a separation electricity removal charger 7B are opposed to each other, a transfer material 8 is sent to the transfer/separation section through a guide 6 and transfer bias having polarity opposite to the polarity of toner is applied to the transfer charger 7A with the result that the toner image on the image bearing member is transferred onto the transfer material 8 under the action of an electric field generated thereby. Then, by applying separation bias having the same polarity as that of toner to the separation electricity removal charger 7B, the transfer material 8 is separated from the image bearing member 1. The separated transfer material is sent to a fixing section (not shown), where the toner image is permanently fixed to the transfer material. Thereafter, the transfer material is discharged out of the apparatus.

The toner used in this apparatus is magnetic toner. The magnetic toner is obtained as follows. 100 weight parts of styrene/butyl methacrylate-dimetyl amino ethyl methacrylate (weight ratio 7:2, 5:0.5) copolymer, 40 weight parts of magnetite having Mohs' hardness of 5.5 at BET specific surface area of 5 $m^2/g$, and 3 weight parts of polypropylene having weight average molecular weight of 15000 and boiling point n-hexane extract of 20 weight % were mixed and were fused and kneaded in a roll mill at a temperature of 160° C. After cooling, the product was roughly ground by a hammer mill and then was finely ground by a jet grinding machine. Then, the powder was classified by an air classifier to obtain black fine powder having volume average particle diameter of about 7.5 $\mu$m.

On the other hand, while 100 weight parts of silica fine powder (specific surface area of about 130 $m^2/g$) obtained by a dry method was being agitated, 12 weight parts of silicone oil (viscosity of 70 cp ($7\times10^{-2}$ Pa·s) at 25° C.; amine equivalent of 830) having amine as side chain was sprayed on the silica fine powder, and treatment was effected for 60 minutes while maintaining the temperature to about 250° C. Tribo electric charged amount of the treated silica was +130 $\mu$c/g. The hardness of the silica was 6.0 (Mohs' hardness).

0.4 weight part of the silica fine powder treated by the silicone oil having amine as side chain was added to 100 weight parts of the magnetic toner.

Figure 2:
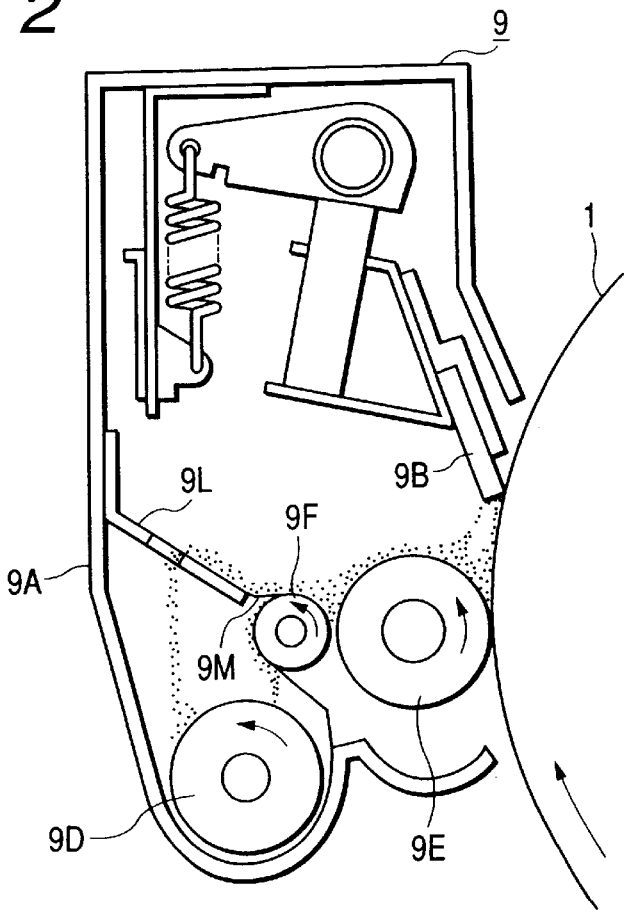
FIG. 2 is a side sectional view of a cleaning device of the image forming apparatus.
Figure 3:
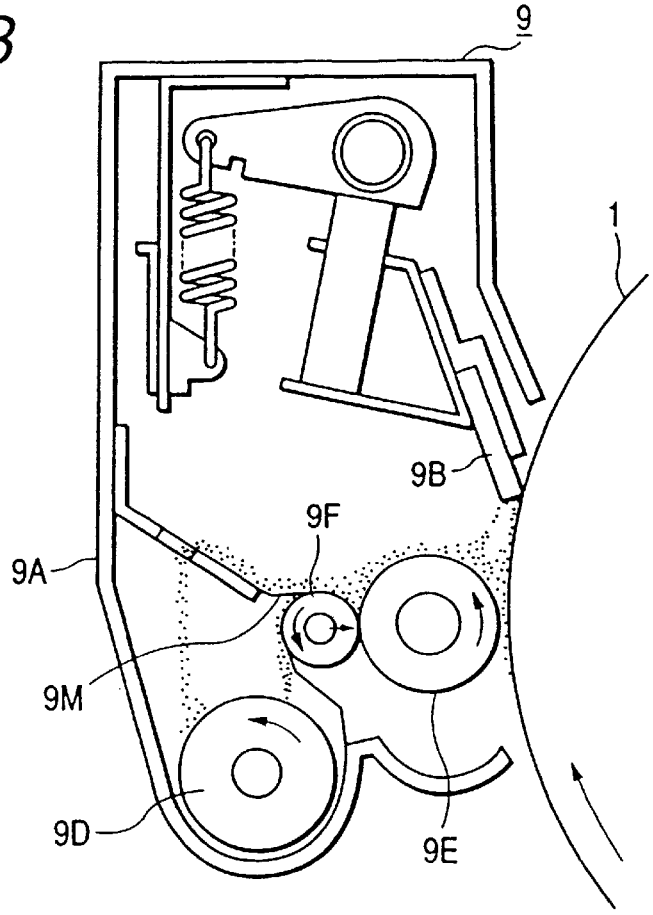
FIG. 3 is a side sectional view of a cleaning device according to a second embodiment of the present invention.

FIG. 2 is a side sectional view only showing a cleaning device 9 of the apparatus. The leaning device shown includes housing 9A in which a cleaning blade 9B is used as cleaning means abutting against the image bearing member 1. The toner scraped off from the image bearing member by the cleaning blade is accumulated in a recess defined by a magnet roller 9E wherein housing 9A, non-magnetic doctor roller 9F and a buffer 9M which are disposed at an upstream side of the cleaning blade (in a rotational direction of the image bearing member) by a predetermined amount, and remaining or excessive toner is dropped onto a conveying screw 9D and then is discharged out of the apparatus. The magnet roller 9E has a gap with respect to the image bearing member 1, and a magnet brush comprised of the magnetic toner and formed on the magnet roller 9E slidingly contacts with the surface of the image bearing member.

By defining the toner accumulating recess by the magnet roller and the like as mentioned above, the amount of toner held by the magnet roller 9E is stabilized to always form uniform toner coating on the roller thereby to apply an optimum amount of toner to a nip between the image bearing member and the cleaning blade, thereby maintaining the sliding ability of the cleaning blade to prevent the turn-over and chattering vibration of the cleaning blade.

Although it is necessary that the optimum amount of toner is always supplied to the magnet roller 9E to achieve the good cleaning function, if the cleaning device is operated for a long term as it is, in dependence upon the environmental condition and/or operating time period, the excessive aggregated matter will be accumulated in the nip to cause the above-mentioned problem.

Figure 6A:
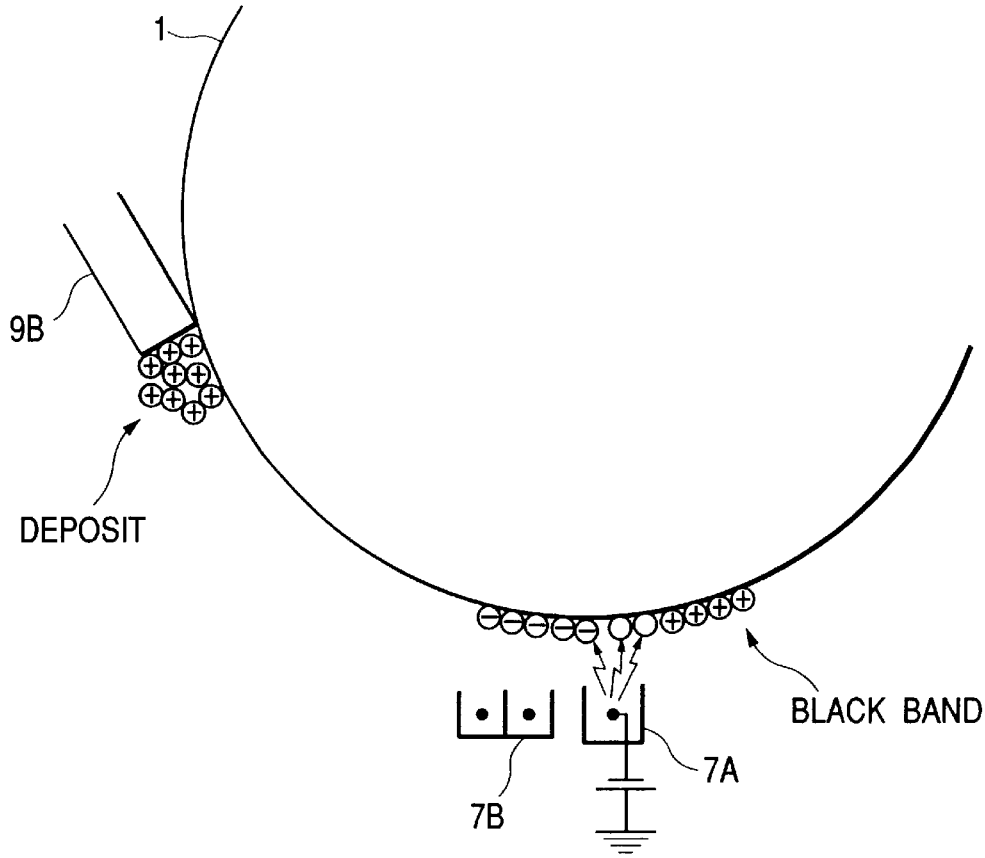
FIGS. 6A and 6B are explanatory views for explaining aggregation or coherence of toner at an edge of a cleaning blade by black band.
Figure 6B:
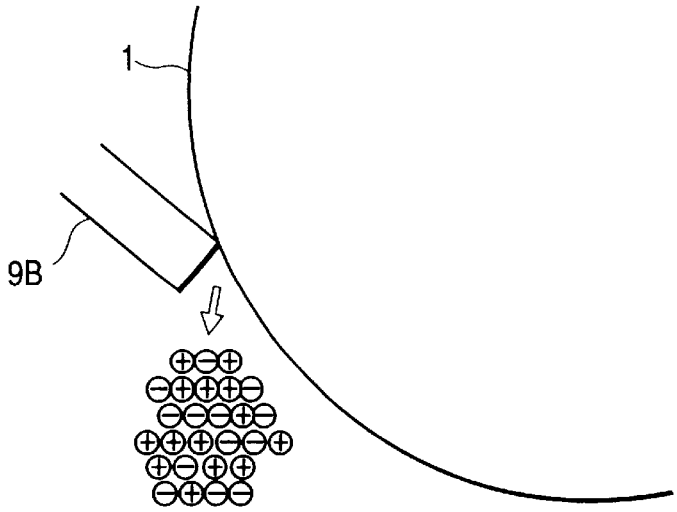

To cope with this, in the illustrated embodiment, the toner supplied to an area of the image bearing member which is not contacted with the transfer material in the developing process is passed through the transfer section in a condition that the transfer material is not passed, and, in this case, as shown in FIG. 6A, the developer is charged with polarity opposite to the normal charging polarity by means of charge applying means to which bias having polarity opposite to that in the transferring by the charge applying means, with the result that the developer is brought to the blade edge to contact it with the accumulated matter, thereby forcibly aggregating the accumulated matter electrostatically to grow the lump of the accumulated matter. As a result that, as shown in FIG. 6B, the lump is dropped from the blade edge by its own weight.

Since the technique in which the developer formed on the area of the image bearing member which is not contacted with the transfer material is charged with the polarity opposite to the normal charging polarity and is supplied to the cleaning section as it is (since the developer directly brought to the cleaning section without the transferring process is formed in a band shape along the longitudinal direction of the cleaning blade, it is called as "black band") is different from the intention of fundamental usage of developer, in consideration of consumption of developer, it is apparent that reducing of the number of such techniques executed is more better. A laser light is irradiated on the image bearing member in the band shape in advance in order to form the black band on the image bearing member by the developing device.

Further, the amount of the accumulated matter formed by the electrostatic aggregation depends upon the operating environment and operating amount of the main body of the image forming apparatus. Accordingly, by appropriately setting the timing for carrying the black band developer to the cleaning blade in consideration of these conditions, useless developer is not consumed, and good cleaning can always be effected.

In the illustrated embodiment, a sequence for carrying the inversely charged developer to the cleaning device is set as follows.

The operating condition of the main body of the image forming apparatus includes the total operating time of the main body of the image forming apparatus (T (hours)), average imaging ratio (P %) during the operation (print ratio when solid black print is 100%), and moisture amount in air under the operating environment (W (g/1 kg-air)), and it is assumed that the amount of developer supplied to the blade edge once is 1.0 and the number of transfer materials passed till the next supply of developer is C (sheets/1 seq).

The period of operation for directly carrying the developer to the blade edge of the cleaning device is set as follows:

$$1/C=6\times P\times W^2\times(T/(T+30))$$

Incidentally, the average imaging ratio may be calculated with accumulation from a video count signal for the laser scanner effecting the image exposure, and the moisture amount may be measured by a temperature/humidity sensor.

Incidentally, the number of operations for directly carrying the inversely-charged developer to the cleaning device may be reduced as less as possible on the basis of the number sought from the above equation in order to achieve effective usage of developer and reduction of load acting on the cleaning device.

Next, the process for charging the developer carried to the cleaning device as it is without the transferring by means of the image bearing member with inverse polarity will be explained.

In the image forming apparatus shown in FIG. 1, the charging amount of developer supplied from the developing roller 4 of the developing device 3 to the image bearing member 1 is +14 $\mu$C/g, and, while the developer is being passed between the opposed image bearing member 1 and transfer charger 7A, by driving such charger, the charging amount of developed is changed to −10 $\mu$C/g. Meanwhile, current of −700 $\mu$A is supplied to a charging wire of the transfer charger, with the result that current of −100 $\mu$A flows toward the direction of the image bearing member by corona discharge.

Also in the transfer process, the similar current is supplied to the charging wire in the same manner as the case where the developer is directly carried to the cleaning device without the transferring. When the developer is charged with polarity opposite to the normal charging polarity at the transfer charger, the separation electricity removal charger 7B is not operated because the corona discharge caused by the separation electricity removal charger may partially cancel the action of corona discharge caused by the transfer charger.

The transfer charger 7A and the separation electricity removal charger 7B are generally constructed as follows.

The transfer charger 7A extends along the axial direction of the image bearing member 1 and has an opening opposed to the image bearing member and includes a shield case comprised of a conductive member grounded, and a charging wire extending longitudinal direction within the case.

An opening width of the shield case is 11 mm, and a distance between the charging wire and the surface of the image bearing member is 13 mm.

The image bearing member 1 is constituted by a cylinder having a diameter of 108 mm and is rotated at a peripheral speed of 300 mm/sec. An axial dimension of the image bearing member is 300 mm, and the opening of the transfer charger 7A is formed so that the corona discharge can be generated through the entire length of the image bearing member. The transfer current can appropriately be set within a range from 250 to 500 $\mu$A in the transferring process, particularly in consideration of the operating environment and moisture amount.

With the arrangement as mentioned above, regardless of the atmospheric operating environment, the bandlike blank can be prevented effectively.

Next, an embodiment in which the amount of toner formed as the black band can be reduced as less as possible will be explained. Although the toner on the cleaning roller 9E is contacted with the image bearing member at this position, since this toner is residual toner remaining on the image bearing member after the transferring, this toner was charged with positive polarity, i.e., normal charging polarity. In this condition, if the black band toner negatively charged reaches this position, a bad influence may affect on the accumulated matter on the cleaning blade 9B. Thus, this is not preferable.

To avoid this, in this embodiment, a distance between the cleaning roller 9E and the doctor roller 9F is reduced to reduce a thickness of the toner layer on the cleaning roller, thereby reducing the entering amount of toner on the cleaning roller 9E into the image bearing member. This is effected by approaching a shaft of the doctor roller 9F toward the cleaning roller. More specifically, the normal entering amount of toner on the cleaning roller 9E into the image bearing member was selected to 0.3 mm, and a shifting amount of the doctor roller 9F for reducing the thickness of the toner layer was selected to 0.6 mm.

By appropriately setting the sequence for approaching the shaft of the doctor roller 9F to the cleaning roller 9E, the toner on the cleaning roller is spaced apart from the image bearing member before the black band toner enters into the cleaning device, and, when the black band toner is shifted to the nip of the cleaning blade 9B, the toner is contacted with the image bearing member again. That is to say, while the black band toner is being passed at least the position of the cleaning roller 9E, the toner on the cleaning roller is not contacted with the black band toner by reducing the thickness of the toner layer on the cleaning roller.

With this arrangement, it is possible to remove the accumulated matter accumulated at the blade edge by a smaller amount of toner. Indeed, in case of the apparatus according to the aforementioned embodiment, the toner amount required for forming the black band is about 1.0 g; whereas, in this embodiment, the toner amount can be reduced to 0.5 g.

Further, with this arrangement, since the black band toner directly reaches the blade edge, the black band image itself can be changed, so that, for example, in case of a half-tone image, by initially forming the black band by using a small amount of toner, the excessive toner can effectively by prevented from being dripped by the influence of separation claw substantially contacted with the image bearing member.

Figure 4:
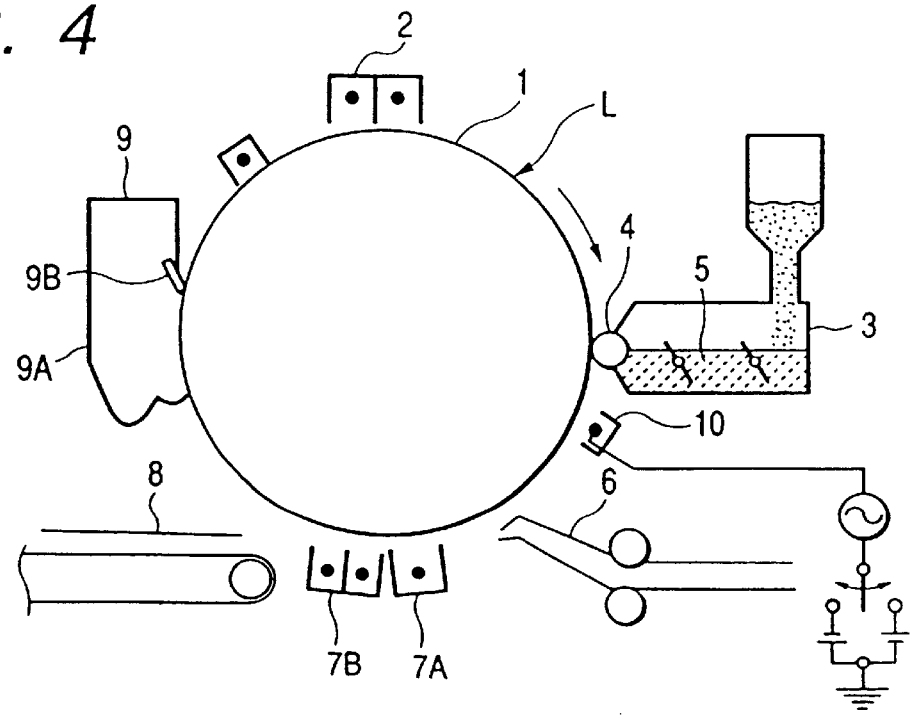
FIG. 4 is a side sectional view of a cleaning device according to a third embodiment of the present invention.

Next, an embodiment in which the present invention is applied to an apparatus wherein a post-charger 10 for enhancing the transferring efficiency by re-charging the toner image formed on the image bearing member is disposed at a downstream side of the developing device and at an upstream side of the transfer charger 7A, as shown in FIG. 4, will be explained.

Incidentally, the post-charger is subjected to voltage obtained by overlapping positive DC voltage with AC voltage having peak-to-peak voltage of 1300 V to apply discharge to the toner image on the image bearing member, thereby making the charging amount of the toner image to a predetermined value (concretely, 20 $\mu$C/g) thereby to uniform transferring effect of the entire image.

In such a post-charger, black band toner area which is an area of the image bearing member not contacted with the transfer material is subjected voltage obtained by negative DC voltage with AC voltage, thereby applying current of −100 $\mu$A toward the image bearing member. As a result, the positively charged toner is negatively charged efficiently, and the charging amount becomes −10 $\mu$C/g.

By using such an apparatus, negative polarity bias was applied to the transfer charger in the apparatus according to the first embodiment to charge the black band toner negatively, it was found that the charging amount of the black band toner become −25 $\mu$C/g.

The toner charged to this extent has a strong electrostatic attracting force to the image bearing member and is not almost subjected to influence of the toner supplying action of the cleaning roller 9E to the image bearing member and affects a strong influence upon the accumulated matter at the blade edge, thereby dropping the accumulated matter effectively.

As mentioned above, in the image forming apparatus utilizing the electrostatic transferring process, since the toner charged with polarity opposite to the normal charging polarity is carried to the accumulated matter accumulated on the edge of the cleaning blade to positively aggregate the accumulated matter electrostatically thereby to drop the accumulated matter by its own weight, the accumulated matter adhered to the blade edge can be removed very effectively, thereby preventing poor cleaning such as so-called streaklike blank and bandlike blank very effectively.

What is claimed is:

1. An image forming apparatus comprising:

an image bearing member;

developing means for developing an electrostatic latent image formed on said image bearing member with developer;

cleaning means for removing residual developer on said image bearing member by contacting with said image bearing member at a cleaning position, wherein a developer image formed on said image bearing member by said developing means is transferred onto a transfer material, and said developing means applies developer to an area of said image bearing member which is not contacted with the transfer material, and the developer is carried to the cleaning position by said image bearing member; and charge applying means for applying a charge of polarity opposite to a normal charging polarity of the developer to the developer so that the charging polarity of the developer becomes an opposite polarity before the developer applied to said image bearing member is carried to the cleaning position.

2. An image forming apparatus according to claim 1, wherein, whenever number of the transfer materials to which the developer image is transferred reaches a predetermined number, said developing means apply the developer to the area of said image bearing member which is not contacted with the transfer material.

3. An image forming apparatus according to claim 1, wherein frequency for applying the developer to the area of said image bearing member which is not contacted with the transfer material by said developing means is determined in accordance with print ratio of the developer image.

4. An image forming apparatus according to claim 1, further comprising a cleaning roller disposed at a downstream side of a transfer position where the developer image is transferred onto the transfer material and an upstream side of said cleaning means in a shifting direction of said image bearing member, for bearing and carrying the developer to said image bearing member to slidingly contact the developer with said image bearing member, wherein the developer carried by said cleaning roller is spaced apart from said image bearing member when the developer applied to the area of said image bearing member which is not contacted with the transfer material by said developing means is passed a position of said cleaning roller.

5. An image forming apparatus according to claim 1, wherein the developer applied to the area of said image bearing member which is not contacted with the transfer material is formed in a band shape along a longitudinal direction of said cleaning means.

6. An image forming apparatus according to claim 1, wherein said cleaning means have a blade shape.

7. An image forming apparatus comprising:

an image bearing member;

developing means for developing an electrostatic latent image formed on said image bearing member with developer;

cleaning means for removing residual developer on said image bearing member by contacting with said image bearing member at a cleaning position, wherein a developer image formed on said image bearing member by said developing means is transferred onto a transfer material, and said developing means applies developer to an area of said image bearing member which is not contacted with the transfer material, and the developer is carried to the cleaning position by said image bearing member;

charge applying means for applying a charge of polarity opposite to a normal charging polarity of the developer to the developer so that the charging polarity of the developer becomes an opposite polarity before the developer applied to said image bearing member is carried to the cleaning position; and transfer charging means for transferring the developer image onto the transfer material, wherein said transfer charging means is used as said charge applying means.

8. An image forming apparatus according to claim 1 or 7, further comprising separation electricity removal means for removing electricity from the transfer material by being applied voltage having the same charging polarity as the normal charging polarity in order to separate the transfer material from said image bearing member, wherein the voltage applied to said separation electricity removal means is turned OFF when the developer applied to the area of said image bearing member which is not contacted with the transfer material is passed through said separation electricity removal means.

9. An image forming apparatus comprising:

an image bearing member;

developing means for developing an electrostatic latent image formed on said image bearing member with developer;

cleaning means for removing residual developer on said image bearing member by contacting with said image bearing member at a cleaning position, wherein a developer image formed on said image bearing member by said developing means is transferred onto a transfer material, and said developing means applies developer to an area of said image bearing member which is not contacted with the transfer material, and the developer is carried to the cleaning position by said image bearing member;

charge applying means for applying a charge of polarity opposite to a normal charging polarity of the developer to the developer so that the charging polarity of the developer becomes an opposite polarity before the developer applied to said image bearing member is carried to the cleaning position; and transfer pre-charging means disposed at a downstream side of said developing means and at an upstream side of a transfer position where the developer image is transferred onto the transfer material in a shifting direction of said image bearing member, for charging the developer image with a normal charging polarity, wherein said transfer pre-charging means is used as said charge applying means and a voltage having a polarity opposite to the normal charging polarity is applied to said transfer pre-charging means when the developer applied to the area of said image bearing member which is not contacted with the transfer material is passed through said transfer pre-charging means.

10. An image forming apparatus comprising:

an image bearing member;

developing means for developing an electrostatic latent image formed on said image bearing member with developer;

cleaning means for removing residual developer on said image bearing member by contacting with said image bearing member at a cleaning position, wherein a developer image formed on said image bearing member by said developing means is transferred onto a transfer material, and said developing means applies developer to an area of said image bearing member which is not contacted with the transfer material, and the developer is carried to the cleaning position by said image bearing member; and charge applying means for applying a charge of a polarity opposite to normal charging polarity of the developer to the developer so that the charging polarity of the developer becomes an opposite polarity before the developer applied to said image bearing member is carried to the cleaning position, wherein frequency for applying the developer to the area of said image bearing member which is not contacted with the transfer material by said developing means is determined in accordance with an atmospheric environment of the image forming apparatus.

11. An image forming apparatus according to claim 10, wherein the atmospheric environment of the image forming apparatus includes moisture in air and further comprising transfer charging means for transferring the developer image onto the transfer material, wherein said transfer charging means is used as said charge applying means.

* * * * *

UNITED STATES PATENT AND TRADEMARK OFFICE

CERTIFICATE OF CORRECTION

PATENT NO. : 6,438,337 B1
DATED : August 20, 2002
INVENTOR(S) : Takuma Abe

Figure 5:
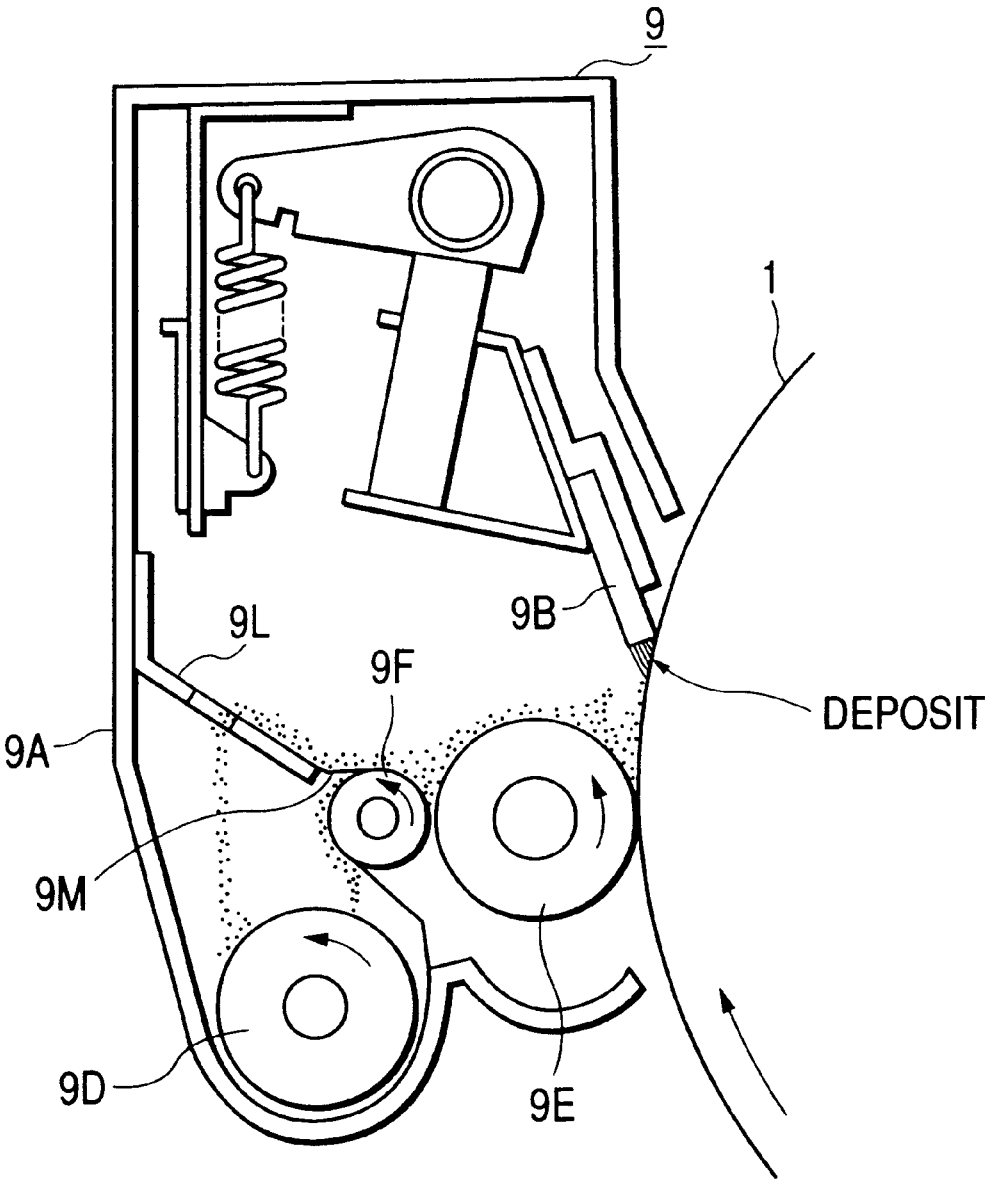
FIG. 5 is a side sectional view of a conventional cleaning device.

It is certified that error appears in the above-identified patent and that said Letters Patent is hereby corrected as shown below:

Drawings,
Sheet 1, FIG. 1, “9a” should read -- 9A --; and “9b” should read -- 9B --;
Sheet 2, FIG. 2, “9L” should be deleted; and
Sheet 3, FIG. 5, should be labeled “PRIOR ART”.

Column 3,
Line 42, “leaning” should read -- cleaning --; and
Line 56, “member.” should read -- member 1. --.

Column 5,
Line 15, “developed” should read -- developer --.

Column 6,
Line 29, “by” should read -- be --;
Line 45, “to” should read -- making --;
Line 60, “not” should be deleted; and
Line 61, “subjected” should read -- not subjected --.

Signed and Sealed this

Sixth Day of January, 2004

JAMES E. ROGAN
*Director of the United States Patent and Trademark Office*